US011305247B2

(12) United States Patent
Cheng

(10) Patent No.: US 11,305,247 B2
(45) Date of Patent: Apr. 19, 2022

(54) MAGNETIC STIRRER, USE OF A DECORATIVE INLAY AND METHOD FOR PERSONALIZING A MAGNETIC STIRRER

(71) Applicant: IKA—Werke GmbH & Co. KG, Staufen (DE)

(72) Inventor: Bird Cheng, Guangzhou (CN)

(73) Assignee: IKA-Werke GmbH & Co. KG, Staufen (DE)

( * ) Notice: Subject to any disclaimer, the term of this patent is extended or adjusted under 35 U.S.C. 154(b) by 290 days.

(21) Appl. No.: 16/431,235

(22) Filed: Jun. 4, 2019

(65) Prior Publication Data

US 2019/0366284 A1 Dec. 5, 2019

(30) Foreign Application Priority Data

Jun. 5, 2018 (CN) ..... 201810568677.3

(51) Int. Cl.
*B01F 33/45* (2022.01)
*B44C 5/00* (2006.01)
*B01F 33/452* (2022.01)

(52) U.S. Cl.
CPC ..... *B01F 33/45* (2022.01); *B01F 33/452* (2022.01); *B44C 5/005* (2013.01)

(58) Field of Classification Search
CPC ..... B01F 13/08; B01F 13/0818
USPC ..... 366/273, 274
See application file for complete search history.

(56) References Cited

U.S. PATENT DOCUMENTS 3,109,791 A * 11/1963 Gordon ..... C25B 1/00 205/550
3,306,829 A * 2/1967 Patterson ..... B01D 3/06 202/175
4,991,973 A * 2/1991 Maaz ..... B01F 13/0818 177/212
6,332,706 B1 * 12/2001 Hall ..... B01F 3/04794 261/83
6,939,032 B2 * 9/2005 Cosby ..... B01F 11/0045 366/114
2003/0128626 A1 * 7/2003 Verkerk ..... B01F 13/0818 366/140
2014/0286120 A1 * 9/2014 Kolar ..... B01F 13/047 366/142
2015/0314253 A1 * 11/2015 Cysewski ..... B01F 13/0818 366/273

* cited by examiner

*Primary Examiner* — David L Sorkin
(74) *Attorney, Agent, or Firm* — Budzyn IP Law, LLC

(57) ABSTRACT

The invention relates to an easily personalized magnetic stirrer (1), which has a base body (2). The hood (5) can be put over this base body (2). The receiving space (6) for inserting a decorative inlay is then formed between the hood (5) and the base body (2). The receiving space (6) and a decorative inlay (7) inserted therein can be viewed from the outside through an at least area-wise transparent set-up area (4), which is arranged or formed on the hood (5) (see FIG. 1 for comparison).

17 Claims, 4 Drawing Sheets

MAGNETIC STIRRER, USE OF A DECORATIVE INLAY AND METHOD FOR PERSONALIZING A MAGNETIC STIRRER

FIELD OF THE INVENTION

The invention relates to a magnetic stirrer having a base body, a magnetic drive arranged in the base body and a set-up area on which a stirring vessel can be set.

The invention furthermore also relates to the use of a decorative inlay for personalizing a magnetic stirrer and to a method for personalizing a magnetic stirrer, in particular such a one as defined above.

BACKGROUND OF THE INVENTION

Magnetic stirrers of the type defined above are known in diverse embodiments from the prior art. In such magnetic stirrers, provision is made for setting a stirring vessel on the set-up area of the magnetic stirrer and setting a stirring magnet arranged in the stirring vessel in rotation using the magnetic drive in order to mix the medium to be stirred in the stirring vessel.

With such magnetic stirrers there is a need for personalizing the appearance of these magnetic stirrers, for example in order to adapt the magnetic stirrers to the corporate identity of a company in which the magnetic stirrers will be used.

The object of the invention is therefore to provide a magnetic stirrer and a method for personalizing a magnetic stirrer of the aforementioned type, with which it is possible to personalize the magnetic stirrer easily and economically.

SUMMARY OF THE INVENTION

To solve this object, a magnetic stirrer having the means and features of the independent claim relating to a magnetic stirrer is proposed. In particular, a magnetic stirrer of the aforementioned type is thus proposed, which comprises a hood that can be put over and in the use position is put over the base body, and a receiving space for a decorative inlay, wherein the set-up area of the magnetic stirrer is arranged or formed on the hood and is transparent, at least in areas, and wherein the receiving space in the use position of the hood on the base body is arranged beneath the set-up area such that a decorative inlay arranged in the receiving space is visible from the outside through the at least area-wise transparent set-up area.

In this manner, a personalized decorative inlay, which for example can be provided with a company logo, can be arranged in the receiving space of the magnetic stirrer underneath the at least area-wise transparent set-up area and be viewed from the outside. The magnetic stirrer can thus be personalized in an expedient manner.

The at least area-wise set-up area can be formed on an at least area-wise transparent set-up plate, which in turn is arranged or formed on the hood. The set-up plate and the hood can thus form a materially homogeneous, monolithic unit, in other words be interconnected in one piece. It is thus possible to produce the hood and the set-up plate in one piece from a material, for instance plastic or glass. However, it is also possible to manufacture the set-up plate with the at least area-wise transparent set-up area formed thereon as a separate part and then connect it to the hood with a base support of the hood.

With the hood situated in the use position on the base body, the receiving space can be formed or arranged between an underside of the set-up plate and an upper side of the base body, in particular delimited by the upper side on the bottom and by the underside on the top.

The magnetic stirrer can be personalized in a particularly expedient manner if the hood can be or is connected to the base body in a non-destructively and/or reversibly detachable manner. The hood can thus be removed from the base body of the magnetic stirrer in order to change a decorative inlay inserted in the receiving space and placed back on and reattached to the base body after the decorative inlay has been changed.

To this end, a releasable lock can be formed between the hood and the base body. This releasable lock can preferably be manually releasable, in particular without having to use tools. It is also possible for the hood and/or the base body to have at least one actuation element that is accessible from outside, with which the lock between the hood and the base body can be released in order to remove the hood from the base body.

With the at least one actuation element, for example, a latch can be moved to and from a locking position and an open position. In the locking position, the latch can engage in a correspondingly formed counterpart element, for example in a groove. This counterpart element can be formed on the hood if the latch is arranged on the base body. If the latch is arranged on the hood, then the counterpart element can be formed accordingly on the base body. The at least one actuation element can be movable into the open position against a return force of, for example, a return spring, acting in the direction of the locking position. The lock can be kept closed automatically by the return force. After the actuation element is released, under the effect of the return force it can furthermore go automatically from its [lacuna] to its locked position, in which the lock is also closed and the hood is thus secured to the base body.

A non-slip coating and/or a non-slip layer can be arranged on an upper side of the base body. With the aid of this non-slip coating and/or non-slip layer, a decorative inlay inserted into the receiving space can be secured in its inserted position and an undesired slipping of the decorative inlay inside the receiving space can be prevented.

The non-slip layer can be resilient. With the aid of the non-slip layer, it is thus possible to press the decorative inlay from below against the underside of the set-up plate and achieve a close contact of the decorative inlay on the underside of the set-up plate. Air bubbles between the set-up plate and the decorative inlay can thus be avoided and the visibility of the decorative inlay through the transparent set-up plate can thus be improved.

The non-slip layer can also be a resilient pad. For example, rubber pads or foam rubber pads can be used as resilient pads. Particularly preferably, the non-slip layer can be preloaded or sandwiched between the upper side of the base body and the underside of the hood or of the set-up area or set-up plate on which the set-up area can be formed, with the hood in the use position. A decorative inlay inserted in the interstice between the underside of the set-up plate and the upper side of the base body can thus be pressed in a reliable manner on the underside of the at least area-wise transparent set-up area or set-up plate.

However, it is also possible for the magnetic stirrer to have a preferably elastic clamping element. With the hood in the use position, this clamping element can be arranged in a preloaded manner between an underside of the hood, in particular of the set-up area or set-up plate, and an upper side of the base body. The decorative inlay can therefore be pressed from below against the set-up area in a reliable manner, which can improve the visibility thereof from the outside.

In addition, the preloaded non-slip layer can also preload the hood situated in the use position and thus help reduce or prevent any play between the hood and the base body. Using the non-slip layer, the hood can be preloaded on the base body in a particularly expedient manner if a locking device is provided between the hood and the base body.

The hood can cover the entire base body of the magnetic stirrer if at least one operating element that is designed for operating the magnetic stirrer and/or the magnetic drive, at least when the hood is in the use position, is arranged on a user-accessible outer side, in particular on an upper side, of the hood. With the hood, it is possible to enclose the base body such that the hood can protect the base body and the magnetic drive located therein from damage or dirt. Furthermore, the hood can also protect the base body from moisture.

The magnetic stirrer can have a push button, switch, and/or a capacitive and/or an inductive sensor as at least one operating element. With the hood in the use position, this element can be connected via a corresponding connection to a counterpart element on the base body of the magnetic stirrer, e.g., to a counterpart push button, counterpart switch or corresponding input for processing the signals of the operating element, for transmitting operating pulses. However, it is also conceivable for at least one touchpad to be formed on the hood as an operating element, through contact with which a counterpart element on the base body of the magnetic stirrer, which for example can be a push button, switch and/or a capacitive and/or an inductive sensor, can be actuated through the hood and/or through the set-up plate.

The magnetic stirrer can have a particularly compact and to a large extent closed and/or gapless outer form if the hood in the use position on the base body reaches a support surface on which the magnetic stirrer is set. In this manner, the base body of the magnetic stirrer and the magnetic drive situated therein can be reliably protected from dirt and damage by the hood covering them.

With the hood in the use position, it is also possible for an underside of the base body to be flush with an edge, in particular a bottom edge, of the hood that delimits an opening of the hood for inserting the base body. In this manner, the base body disappears completely within the hood when the latter is in the use position on the base body. Only an underside of the base body is then still accessible from outside, whereas the remaining outer sides, in other words lateral surfaces and also the upper side of the base body, can be completely covered by the hood. A depth of an interior space of the hood can be at least as great as a height of the base body so that the base body can fit completely inside the hood.

If the hood has a passage point for a power cable, it is possible to supply the magnetic drive situated in the base body, and optionally other elements of the magnetic stirrer that require current, with power through the hood situated in the use position.

In order to protect the magnetic drive and a decorative inlay inserted in the receiving space from fluids, it can be advantageous if a seal is formed between the hood and the base body. This seal can preferably be designed to close and/or seal the receiving space for the decorative inlay in a tight, in particular fluid-tight, manner.

In order to accentuate the decorative inlay in the receiving space of the magnetic stirrer in a particularly effective manner, it can be advantageous if the magnetic stirrer has an illumination device with which the receiving space can be illuminated. It is thus possible to illuminate a decorative inlay arranged in the receiving space as needed.

The claimed technical teaching can be summarized in other words as follows: The invention relates to an easily personalized magnetic stirrer, which has a base body. The magnetic stirrer comprises a hood, which can be put over the base body. A receiving space for inserting a decorative inlay is formed between the hood situated in the use position and the base body. The receiving space and a decorative inlay inserted therein are visible from the outside through an at least area-wise transparent set-up area of the magnetic stirrer and can therefore be viewed through the set-up area. The set-up area can be formed on an at least area-wise transparent set-up plate. The set-up plate can delimit the receiving space on the top and can be formed or arranged on the hood.

The aforementioned object is also solved by the use of a personalized decorative inlay with a magnetic stirrer according to any one of claims 1 to 12. The appearance of the magnetic stirrer according to the invention can thus be modified and adapted in an expedient manner by means of a personalized decorative inlay.

For solving the object, a method for personalizing a magnetic stirrer is also proposed, which has the means and features of the independent claim pertaining to the method. In particular, a method for personalizing a magnetic stirrer, preferably a magnetic stirrer according to any one of claims 1 to 12, is proposed for solving this object, which method is characterized in that a decorative inlay is first personalized, after which the personalized decorative inlay is inserted in a receiving space, which is visible through a transparent set-up plate of the magnetic stirrer. For personalization, the decorative inlay can be, for example, printed, painted or also laminated. Other methods can also be used for personalizing the decorative inlay.

In order to modify the appearance of the magnetic stirrer, a decorative inlay present in the receiving space can also be replaced by the personalized decorative inlay.

BRIEF DESCRIPTION OF THE DRAWINGS

An exemplary embodiment of the invention is described in more detail below, with reference to the drawing. Depicted in an in part highly schematized manner are shown.

DETAILED DESCRIPTION OF THE INVENTION

Figure 1:
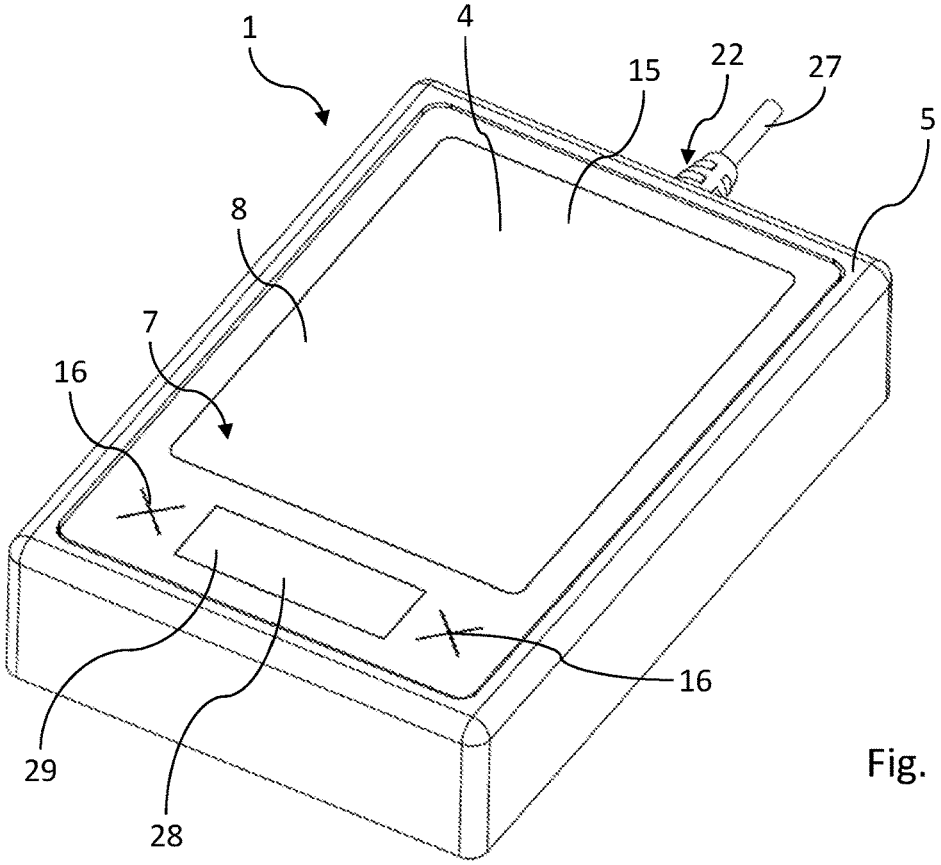
FIG. 1 a perspective view from above of a magnetic stirrer according to the invention, FIG. 2 a perspective view from below of the magnetic stirrer illustrated in FIG. 1, FIG. 3 an exploded view of the magnetic stirrer illustrated in FIGS. 1 and 2, in which a base body of the magnetic stirrer, a hood for covering the base body of the magnetic stirrer and a decorative inlay arranged between the hood and the base body can be discerned, FIG. 4 a highly schematized exploded view of the magnetic stirrer, rotated 180 degrees in comparison to FIG. 3, FIG. 5 a top view of the magnetic stirrer illustrated in FIGS. 1 to 4, FIG. 6 a sectional lateral view of the magnetic stirrer, cut along the line A-A illustrated in FIG. 5, and FIG. 7 a sectional lateral view of the magnetic stirrer, cut along the line B-B illustrated in FIG. 5.
Figure 2:
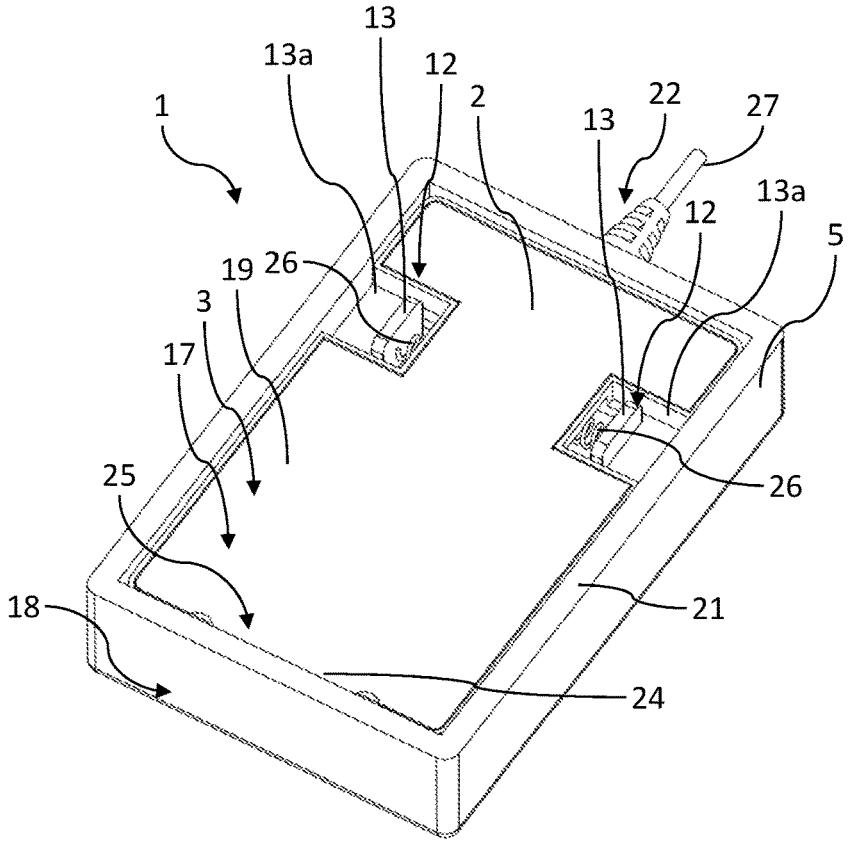
Figure 3:
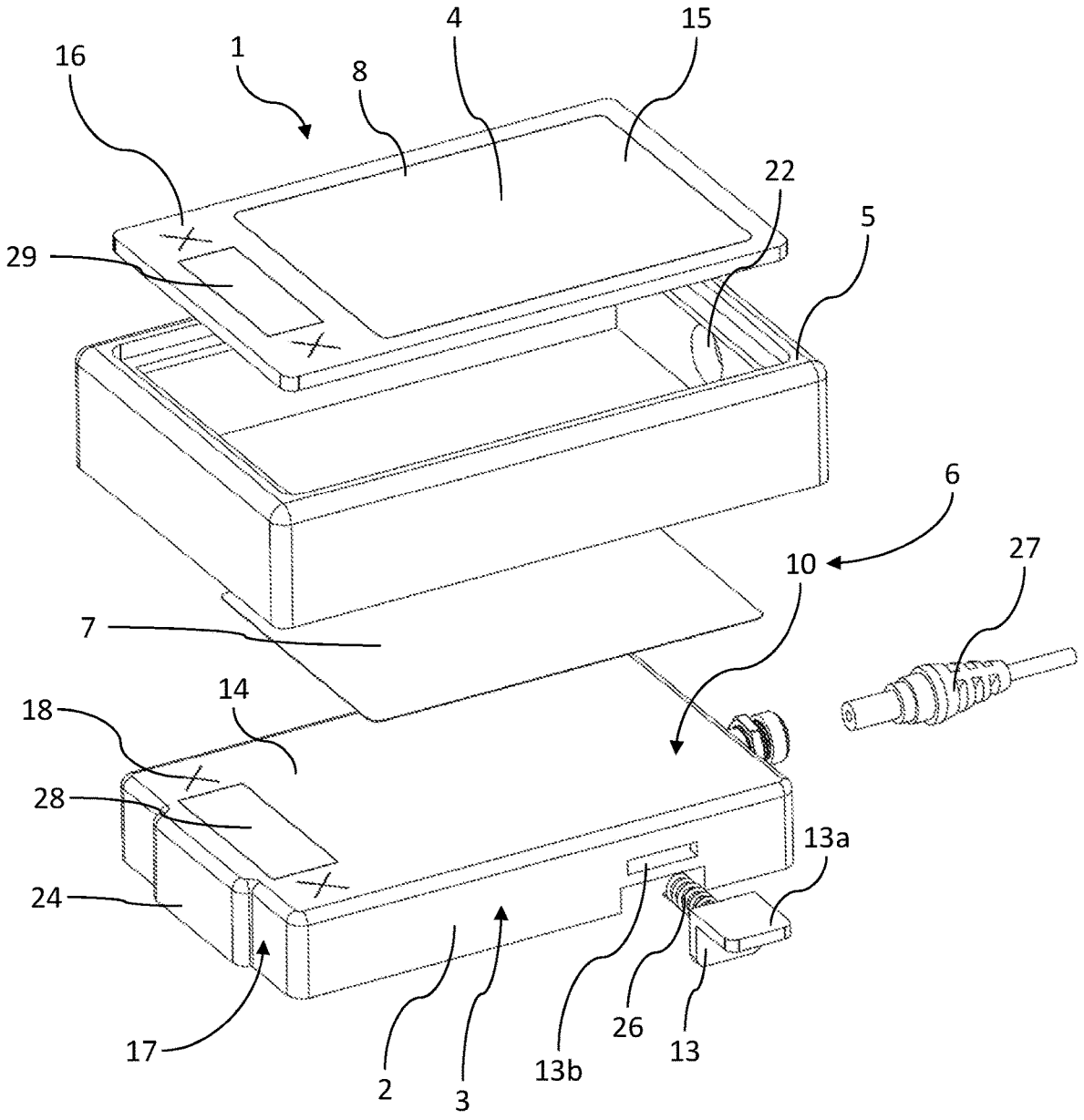
Figure 4:
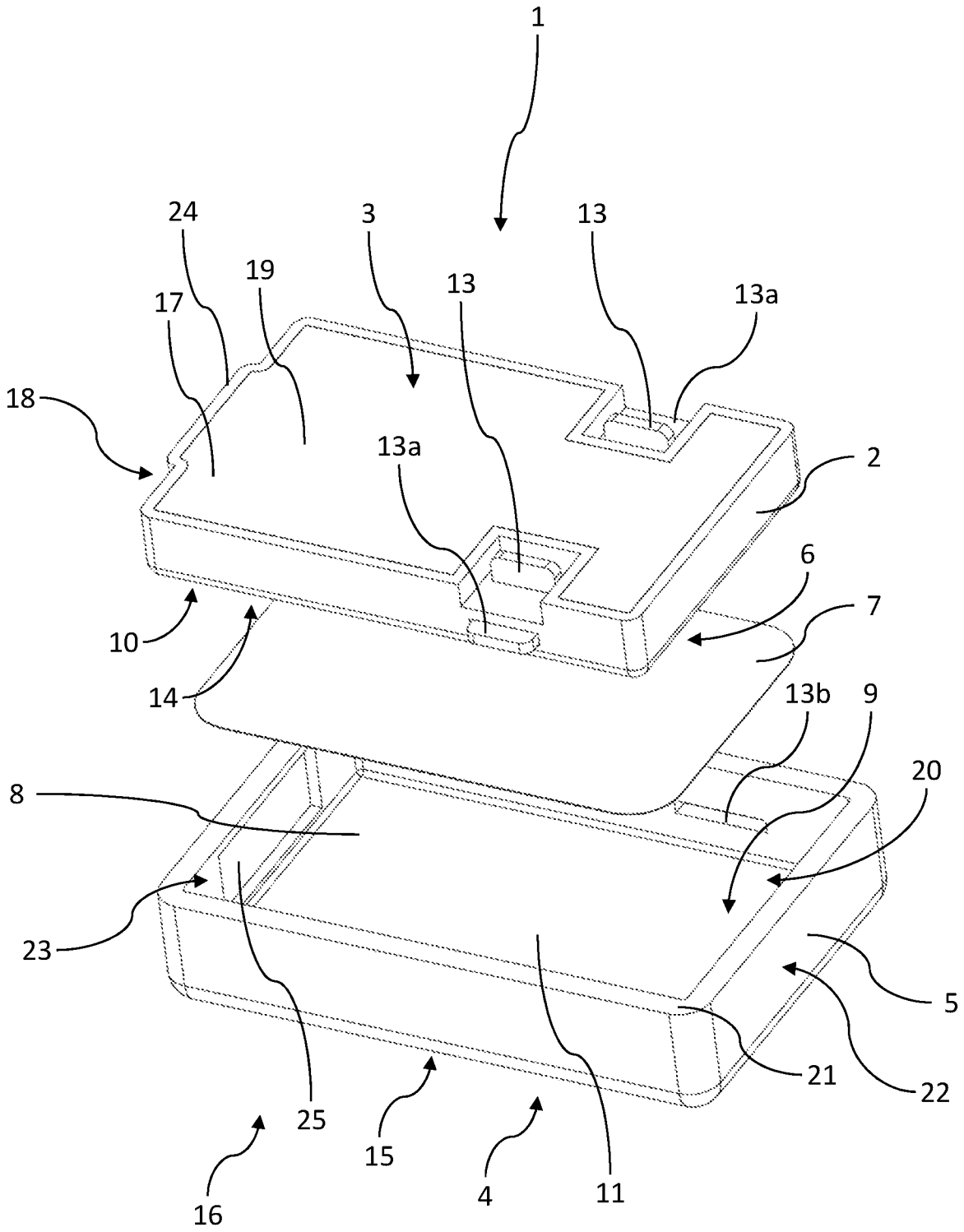
Figure 5:
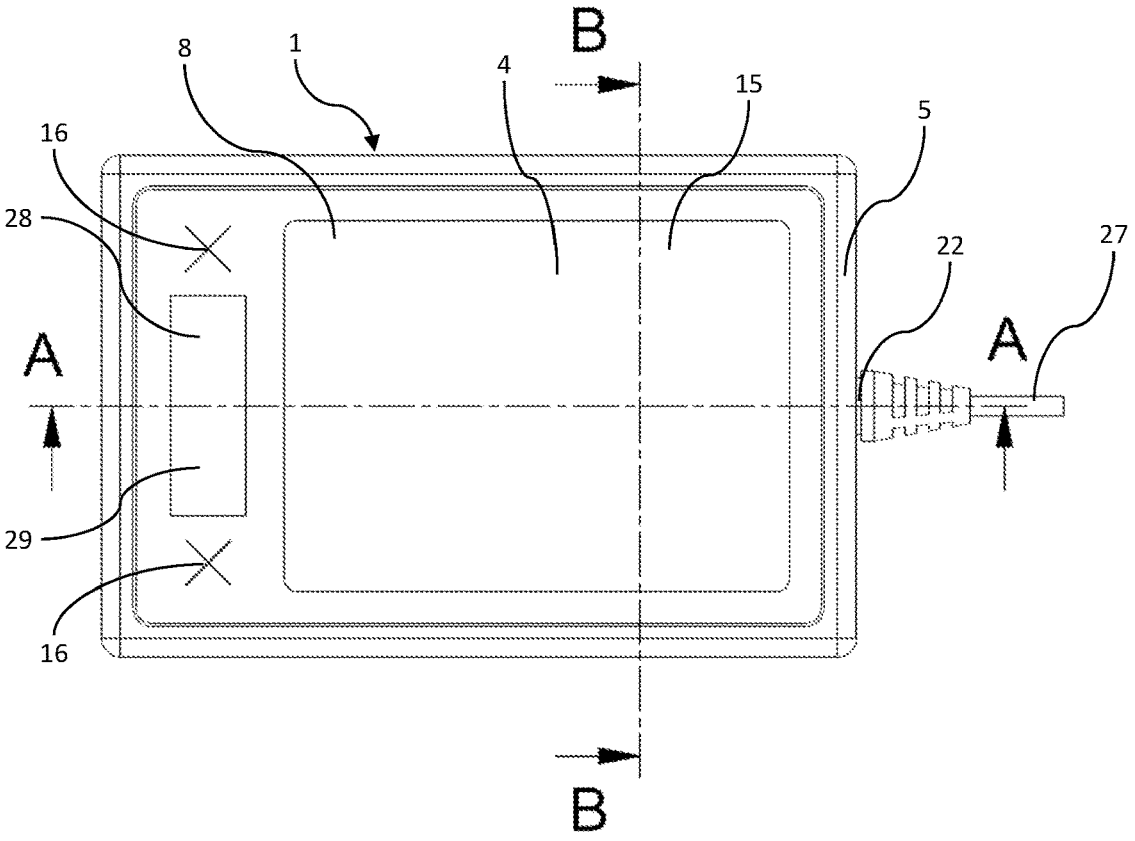
Figure 6:
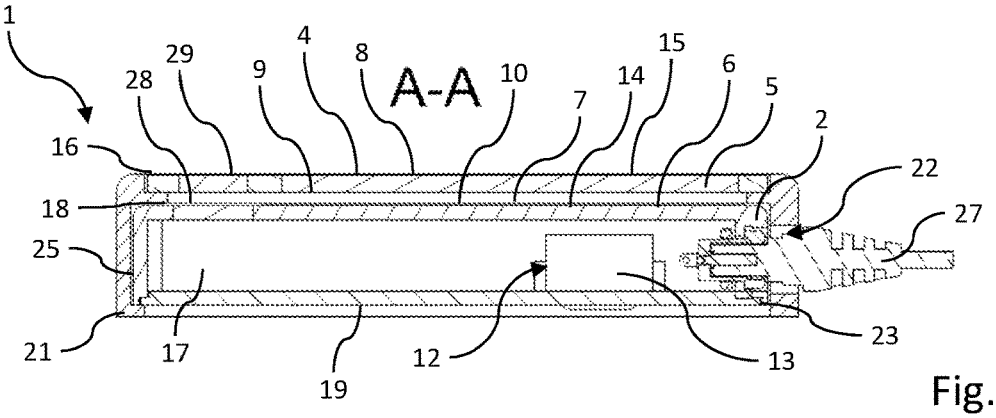
Figure 7:
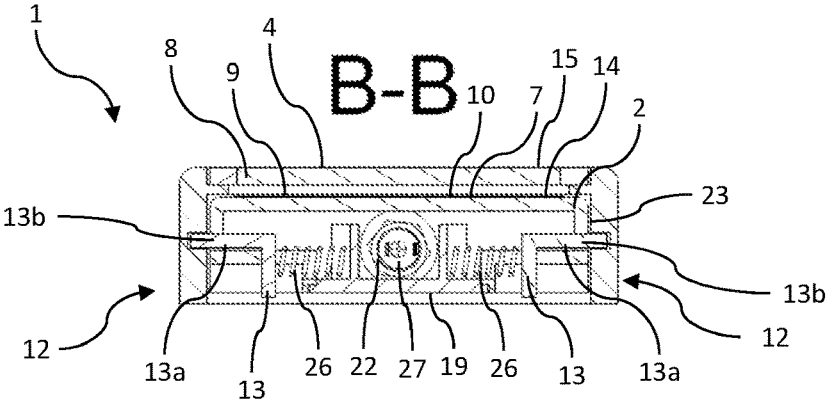

FIGS. 1 to 7 show a magnetic stirrer, denoted in its entirety by 1. The magnetic stirrer 1 has a base body 2, in which a magnetic drive 3 is arranged. On its upper side, the magnetic stirrer 1 has a set-up area 4, on which a stirring vessel (not illustrated separately in the figures) is set. A stirrer magnet can be placed in the stirring vessel set on the set-up area 4, which stirrer magnet can be magnetically coupled to the magnetic drive in order to set it in rotation for mixing a medium to be stirred in the stirring vessel.

The magnetic stirrer 1 comprises a hood 5, which can be put and which in its use position is put over the base body 2, and a receiving space 6 for receiving a personalized decorative inlay 7. The set-up area 4 is formed on a set-up plate 8 arranged on the hood 5. In the use position of the hood 5 on the base body 2, the receiving space 6 is formed between an underside 9 of the set-up plate 8 and an upper side 10 of the base body 2, and delimited by these sides on the top and bottom when the base body 2 is inserted in its use position inside an interior space 11 of the hood 5 defined by the hood 5.

The set-up plate 8 and thus the set-up area 4 are transparent, at least in areas, such that the receiving space 6 and a decorative inlay 7 arranged therein are visible from outside through the set-up area 4 and the set-up plate 8.

The hood 5 can be connected to the base body 2 in a non-destructively and reversibly detachable manner. To this end, a releasable lock 12 is formed between the hood 5 and the base body 2. The base body 2 has in total two actuation elements 13, each accessible from outside and spring-loaded by a return spring 26, with which the lock 12 can be released as needed. The actuation elements 13 are connected to latches 13*a*, which in the locking position engage in grooves 13*b* formed on the inner surfaces facing the interior space 11 of the hood 5. To release the lock 12, the actuation elements 13 are actuated against the return force of the return springs 26, thus pulling the latches 13*a* out of the grooves 13*b*. If the actuation elements 13 are then released, they are automatically returned in conjunction with the latches 13*a* to their locking position by the return force of the return springs 26.

A non-slip coating 14, aka non-slip layer 14, is arranged on the upper side 10 of the base body 2. A slipping of the decorative inlay 7 in the receiving space 6 of the magnetic stirrer 1 can be prevented using this non-slip coating or layer 14.

Preference is given to using a resilient pad as a non-slip layer. For example, rubber pads or foam rubber pads can be used as resilient pads. With the hood 5 in the use position, the resilient pad is arranged between the upper side 10 of the base body 2 and the underside 9 of the set-up plate 8. Because the non-slip layer 14 in the form of a resilient pad exerts a return force as soon as it is preloaded, the non-slip layer 14 between the upper side 10 of the base body 2 and the underside 9 of the set-up plate 8 can be used to press the decorative inlay 7 in a reliable manner on the underside of the 9 of the set-up plate 8 and thus improve the visibility of the decorative inlay 7 through the set-up plate 8.

Several operating elements 16 are arranged on an outer side accessible to a user, in this case an upper side 15 of the hood 5. These operating elements 16 are designed for operating the magnetic stirrer 1 and its magnetic drive 3 when the hood 5 is in the use position. The operating elements 16 are touchpads. If the touchpads 16 are touched by a user, operating pulses can be captured in a contactless manner through the hood 5 and/or through the set-up plate 8 and converted to control pulses by counterpart elements 18 disposed on the base body 2 of the magnetic stirrer 1. The control pulses are transmitted to the control unit 17 of the magnetic stirrer 1. As suitable counterpart elements 18, use can be made of inductive and/or capacitive sensors, push buttons and/or switches, for example.

The hood 5 is configured such that in the use position on the base body 2, it reaches a support surface on which the magnetic stirrer is set. With the hood 5 in the use position, an underside 19 of the base body 2 is thus at least flush with a bottom edge 21 of the hood 5 that delimits an insertion opening 20 of the hood 5 for the base body 2, or is even arranged recessed within the interior space 11 of the hood 5. In order to make this possible, a depth of the interior space 11 of the hood 5 is at least as great as a height of the base body 2 of the magnetic stirrer 1.

The hood 5 furthermore has a passage point 22 for a power cable 27. The power cable 27 is guided through the passage point 22 through the hood 5 into the base body 2 of the magnetic stirrer 1. For supplying current to the electric and/or electronic elements of the magnetic stirrer 1, the power cable 27 is then connected to a power source (not illustrated in the figures).

The hood 5 has a recess 25 on an interior side facing the interior space 11 of the hood 5. A correspondingly shaped projection 24 of the base body 2 of the magnetic stirrer 1 engages in this recess 25 when the hood 5 is in the use position. This contributes to a reliable fastening of the hood 5 on the base body 2.

A seal 23 is formed between the hood 5 and the base body 2. The receiving space 6 for the decorative inlay 7 is sealed in a fluid-tight manner by this seal 23.

The magnetic stirrer 1 can also be equipped with an illumination device, with which the receiving space 6 and a decorative inlay 7 arranged therein can be illuminated as needed.

The figures also show that the base body 2 has a display 28 on its upper side 10, via which various information pertaining to, for example, the operation of the magnetic stirrer 1 and its operating parameters can be provided. With the hood 5 set on the base body 2, the display 28 can be observed through a viewing window 29 with which the hood 5 is equipped. The operating elements 16 are formed on the upper side of the hood 5, on both sides of the viewing window 29.

For personalizing the magnetic stirrer 1, first the decorative inlay 7 is personalized (e.g., printed or tinted). The personalized decorative inlay 7 can then be inserted in the receiving space 6 that can be viewed through the transparent set-up plate 8 of the magnetic stirrer 1. Any decorative inlay 7 already in the receiving space 6 can be replaced with the personalized decorative inlay 7.

What is claimed is:

1. A magnetic stirrer (1) having a base body (2), a magnetic drive (3) arranged in the base body (2), a set-up area (4) on which a stirring vessel can be set, and a hood (5) situated on the base body (2) to support the set-up area (4) such that an open receiving space (6) is: i. defined between the base body (2) and the set-up area (4) and ii. perimetrically bounded by the hood (5), wherein the set-up area (4) includes at least one transparent area configured such that a decorative inlay (7) arranged in the receiving space (6) is visible from outside the magnetic stirrer (1) through the at least one transparent area of the set-up area (4).

2. The magnetic stirrer (1) according to claim 1, wherein the set-up area (4) is formed on a set-up plate (8), and wherein the receiving space (6) is arranged between an underside (9) of the set-up plate (8) and an upper side (10) of the base body (2).

3. The magnetic stirrer (1) according to claim 1, wherein the hood (5) is connected to the base body (2) in a reversibly detachable manner.

4. The magnetic stirrer (1) according to claim 1, wherein a releasable lock (12) is formed between the hood (5) and the base body (2) with at least one actuation element (13) with which the lock (12) can be released.

5. The magnetic stirrer (1) according to claim 2, wherein a non-slip layer (14) is arranged on the upper side (10) of the base body (2).

6. The magnetic stirrer (1) according to claim 5, wherein the non-slip layer (14) is a resilient pad which is preloaded between the upper side (10) of the base body (2) and the underside (9) of the set-up plate (8).

7. The magnetic stirrer (1) according to claim 1, further comprising at least one operating element (16) for operating the magnetic stirrer (1).

8. The magnetic stirrer (1) according to claim 7, wherein the at least one operating element (16) includes at least one of a push button, a switch, a capacitive sensor, and an inductive sensor, which with the hood (5) is connected via a corresponding connection to a counterpart element (18) present on the base body (2) of the magnetic stirrer (1) for transmitting operating pulses.

9. The magnetic stirrer (1) according to claim 7, wherein the at least one operative element (16) includes a touchpad (16) on the hood (5), through contact with which a counterpart element (18) on the base body (2) can be actuated.

10. The magnetic stirrer (1) according to claim 9, wherein the counterpart element (18) includes at least one of a push button, a switch, a capacitive sensor, and an inductive sensor.

11. The magnetic stirrer (1) according to claim 1, wherein an underside (19) of the base body (2) is flush with a bottom edge (21) of the hood (5) that delimits an insertion opening (20) of the hood (5) for the base body (2).

12. The magnetic stirrer (1) according to claim 1, wherein the hood (5) has a passage point (22) for a power cable (27).

13. The magnetic stirrer (1) according to claim 1, wherein a seal (23) is formed between the hood (5) and the base body (2) to seal the receiving space (6) for the decorative inlay (7) in a fluid-tight manner.

14. The magnetic stirrer (1) according to claim 1, further comprising an illumination device with which the decorative inlay (7) arranged in the receiving space (6) is illuminated.

15. The magnetic stirrer (1) according to claim 1, wherein a depth of an interior space (11) of the hood (5), into which the base body (2) is inserted, is at least as great as a height of the base body (2).

16. A method for personalizing a magnetic stirrer (1) according to claim 1, wherein a decorative inlay (7) is personalized, after which the personalized decorative inlay (7) is inserted in the receiving space (6) so as to be viewable through the at least one transparent area of the set-up area (4) of the magnetic stirrer (1).

17. The method according to claim 16, wherein a decorative inlay present in the receiving space (6) is replaced with the personalized decorative inlay (7).

* * * * *